United States Patent [19]

Thuries

[11] Patent Number: 4,956,903

[45] Date of Patent: Sep. 18, 1990

[54] METHOD OF PRODUCING AN INSULATING BUSHING FREE FROM ANY RISK OF EXPLOSION

[75] Inventor: Edmond Thuries, Pusignan, France

[73] Assignee: Societe Anmyne Dite, France

[21] Appl. No.: 323,917

[22] Filed: Mar. 15, 1989

[30] Foreign Application Priority Data

Mar. 15, 1988 [FR] France ..... 88 03335

[51] Int. Cl.[5] ..... H01B 19/00

[52] U.S. Cl. ..... 29/631; 29/445; 156/294; 174/31 R; 174/209

[58] Field of Search ..... 174/30, 31 R, 167, 209; 29/631, 445, 234; 156/293, 294; 285/55; 228/131, 132

[56] References Cited

U.S. PATENT DOCUMENTS 1,250,242 12/1917 Stevenson ..... 174/209 X
4,431,859 2/1984 Kishida ..... 174/31 R

FOREIGN PATENT DOCUMENTS 616265 3/1980 Switzerland ..... 174/31 R
1552890 9/1979 United Kingdom ..... 174/31 R

*Primary Examiner*—Laramie E. Askin

[57] ABSTRACT

A method of producing a ceramic insulating bushing to be filed with dielectric gas under pressure and which is free from any risk of explosion, comprising the following operations:

(1) manufacturing a ceramic bushing (10) having an inside surface which is conical over the entire length (L1) of the bushing;

(2) making a conical sleeve (30) of strong insulating material, the sleeve having the same cone angle as the inside surface of the bushing and having a length (L2) which exceeds that of the bushing;

(3) inserting the sleeve (30) into the bushing until it makes contact with the entire inside surface (20) of the bushing (10); and (4) cutting off the sleeve at the ends of the busing.

4 Claims, 5 Drawing Sheets

METHOD OF PRODUCING AN INSULATING BUSHING FREE FROM ANY RISK OF EXPLOSION

The present invention relates to a ceramic insulating bushing filled with dielectric gas under pressure and used for providing a link between various elements of an electrical installation (for example, between an overhead power line and the inside of a circuit breaker).

BACKGROUND OF THE INVENTION

FIG. 1 shows an axial section through a prior art bushing which consists of a unitary porcelain ceramic part 1 with a conical inside surface 2 and outside fins 3.

Cylindrical flanges 4 and 5 at the two ends allow the fitting of collars for fixing the bushing to the apparatus (not shown) to which it is connected.

The bushing is filled with a dielectric gas such as sulfur hexafluoride at a pressure of a few bars. One or more electrical conductors such as 6 pass coaxially through the bushing.

The porcelain may shatter in the event of an external shock; as a result, fragments may be projected violently outwards which could be extremely dangerous both for people and for nearby property.

In order to avoid the risk of the porcelain exploding, a lining 7 of strong material such as epoxy glass is placed adjacent the inside wall of the bushing, with the lining being capable of containing the pressure inside the volume V1 which it encloses, while the volume V2 between the lining 7 and the porcelain ought to be small.

The lining is not completely gas-tight, but in the event of the ceramic rupturing, it is sufficiently gas-tight for the gas to diffuse only slowly through the lining.

For reasons of cost, linings are sized accurately for each model of bushing.

Unfortunately, there are significant manufacturing tolerances in such bushings, about plus or minus one per cent, so that the end diameters D1 and D2 may vary considerably from one bushing to another, even for the same model of bushing.

It is therefore necessary to make linings which have the same lengths as the bushings but which have radial dimensions corresponding to the smallest values in the tolerance ranges of said diameters. The exact position of the lining inside the ceramic is then adjusted using spacers 8.

As a result, volume V2 can become significant (up to 30% of the total volume of the bushing in the worst case), and the gas contained within it could cause a dangerous explosion in the event of the ceramic rupturing.

It has been proposed to make linings which are exactly matched to each bushing, but that solution must be rejected for obvious economic reasons.

It has also been proposed to make the volume V2 between the lining and the ceramic completely gas-tight and to maintain within it a dielectric gas pressure which is lower than that in the volume V1.

Such a solution is clearly expensive since it is necessary to ensure that the volume is gas-tight, to fill the two volumes separately, and to provide two pressure monitoring systems.

It is an aim of the invention to produce a lined bushing at no increase in cost, said bushing being completely free from any risk of explosion.

The applicant has based the invention on the observation that the manufacturer can readily make bushings having a highly constant cone angle, even though there is considerable variation in the diameters of different bushings of the same model.

SUMMARY OF THE INVENTION

Thus the method according to the invention consists in making a bushing which is uniformly conical throughout its length, in producing a conical sleeve which has the same cone angle as the bushing but which exceeds it in length, in introducing the sleeve into the bushing until the sleeve makes contact with the inside surface of the bushing, and then in cutting off the sleeve at the two ends of the bushing.

Volume V2 is therefore substantially zero, regardless of any error in the dimensions of the bushing.

BRIEF DESCRIPTION OF THE DRAWINGS

An embodiment of the invention is described with reference to the accompanying drawings in which.

DETAILED DESCRIPTION

Figure 1:
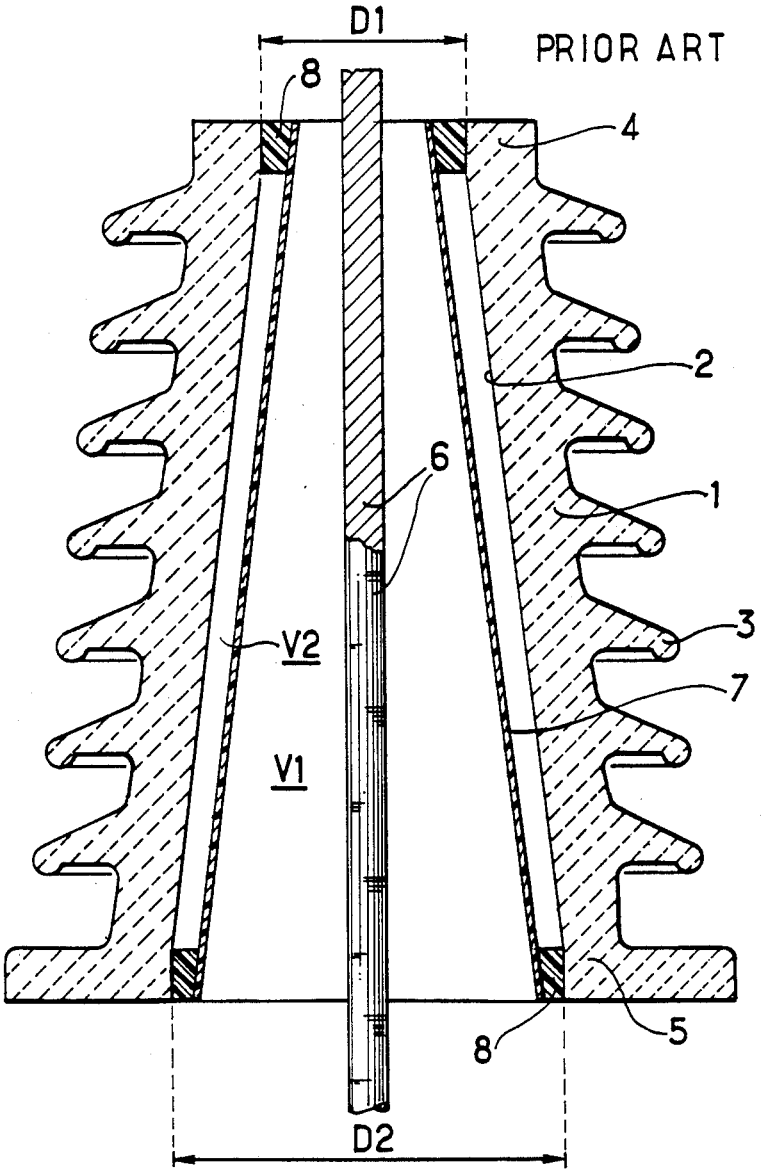
FIG. 1 is an axial section view of a prior art bushing.

FIG. 1 has already been discussed in connection with the prior art.

Figure 2A:
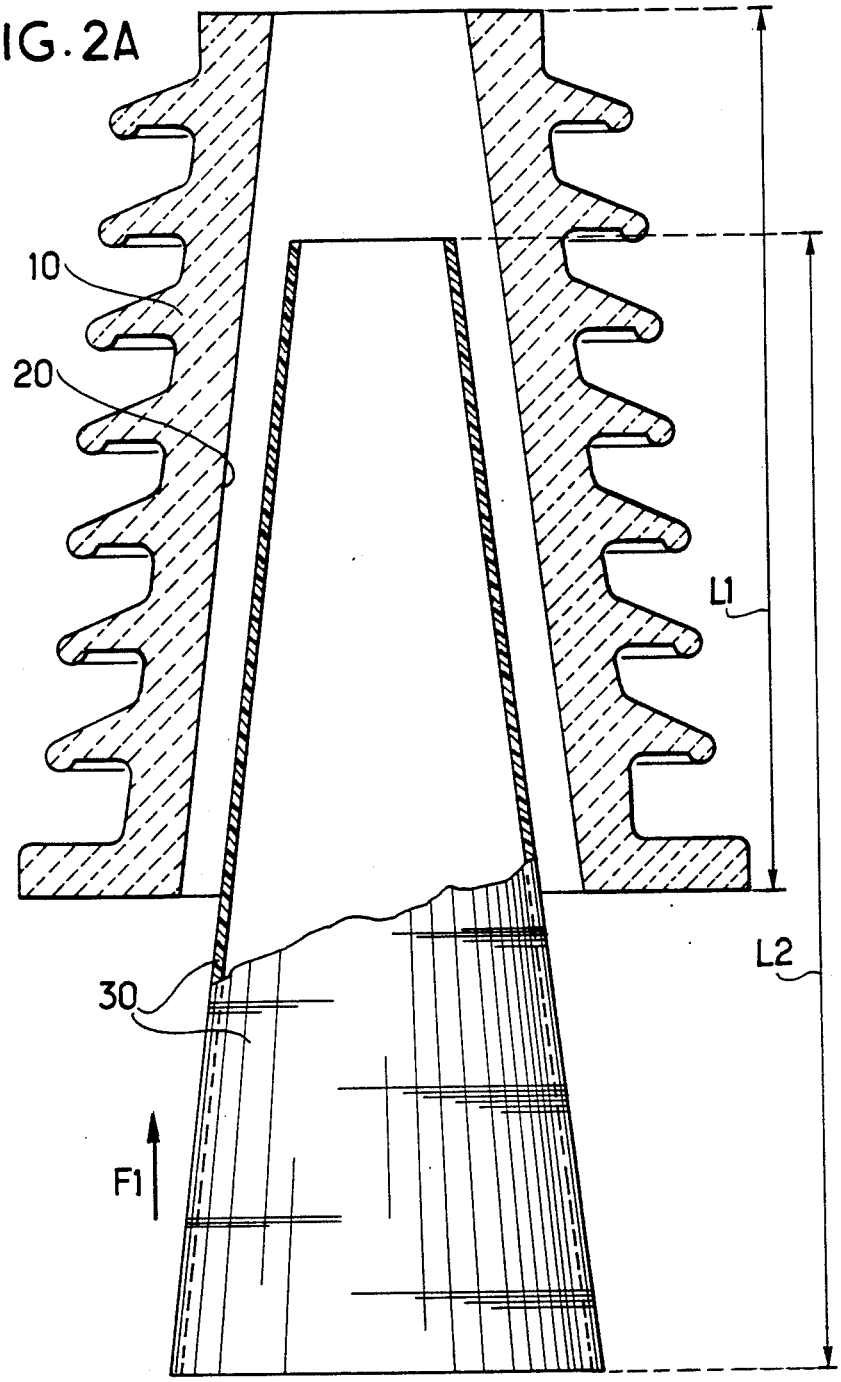
FIGS. 2A and 2B are diagrams showing the stages in the manufacturing method according to the invention.

In the method according to the invention, a ceramic bushing 10 is produced (FIG. 2A), having an inside surface 20 which is conical for the entire length L1 of the bushing.

Figure 2B:
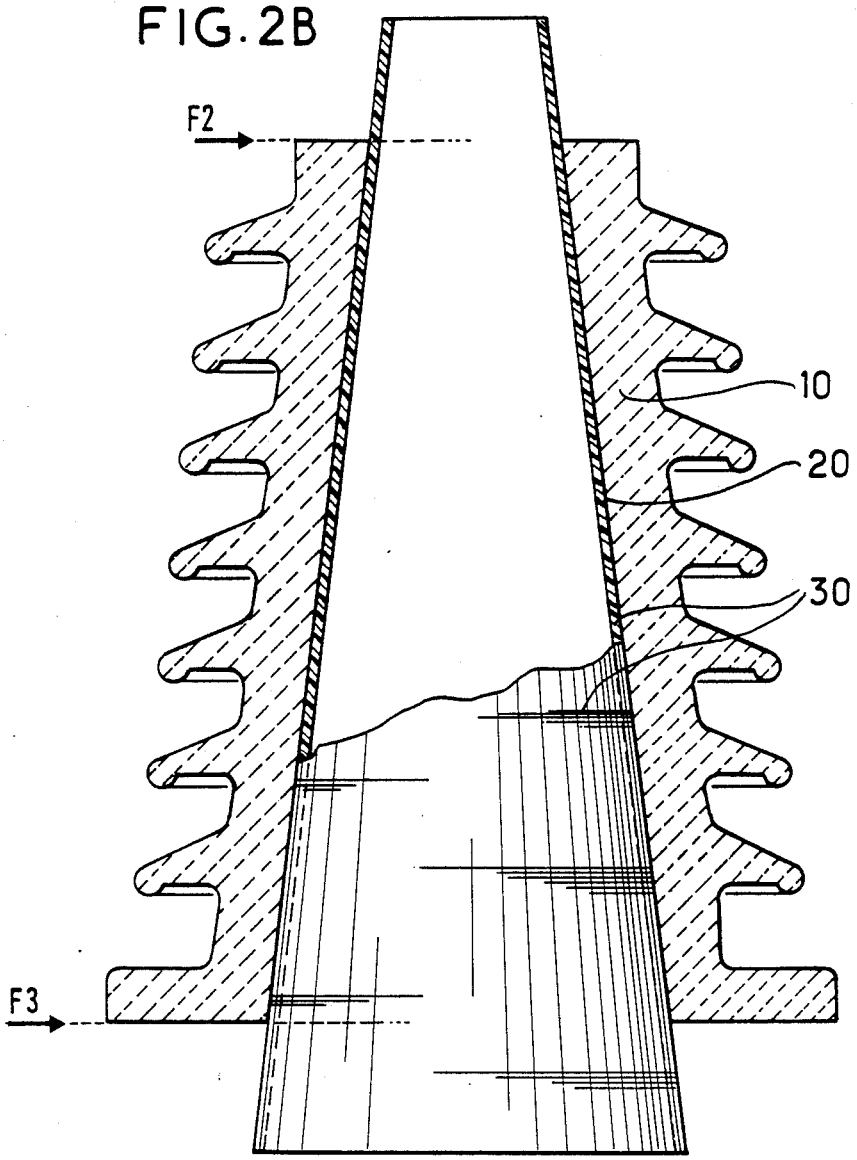

A sleeve 30 is made of epoxy glass (or some other material having similar properties) which has the same cone angle as the bushing and a length L2 which exceeds L1. The sleeve is inserted into the bushing in the direction of the arrow F1 until the outside surface of the sleeve makes contact with the inside surface of the bushing (FIG 2B).

Figure 2C:
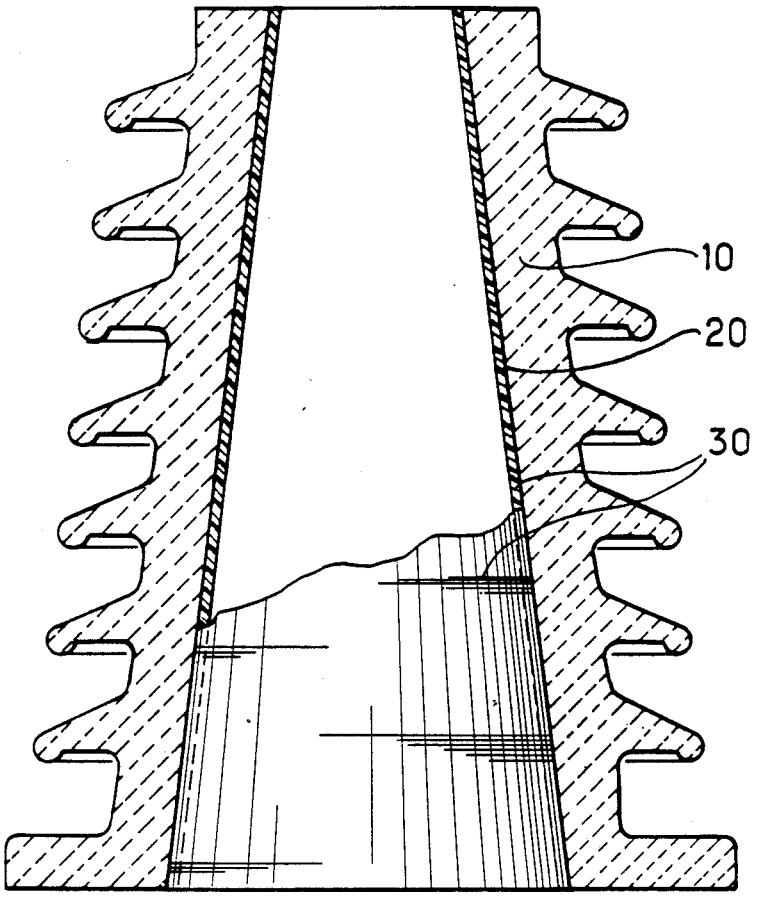
FIG. 2C is an axial sectional view of a bushing as a finished product made in accordance with the sequence of FIGS. 2A and 2B.

The sleeve is then cut off flush with the ends of the bushing FIGS. 2C, (arrows F2 and F3 show the directions in which cutting is carried out).

The person skilled in the art can calculate the length L2 which is required in order to suit all the bushings of a given model taking account of the known manafacturing tolerances.

The sleeve 30 may be secured to the inside surface by means of an adhesive such as epoxy resin. This allows a thinner sleeve to be chosen.

Figure 2D:
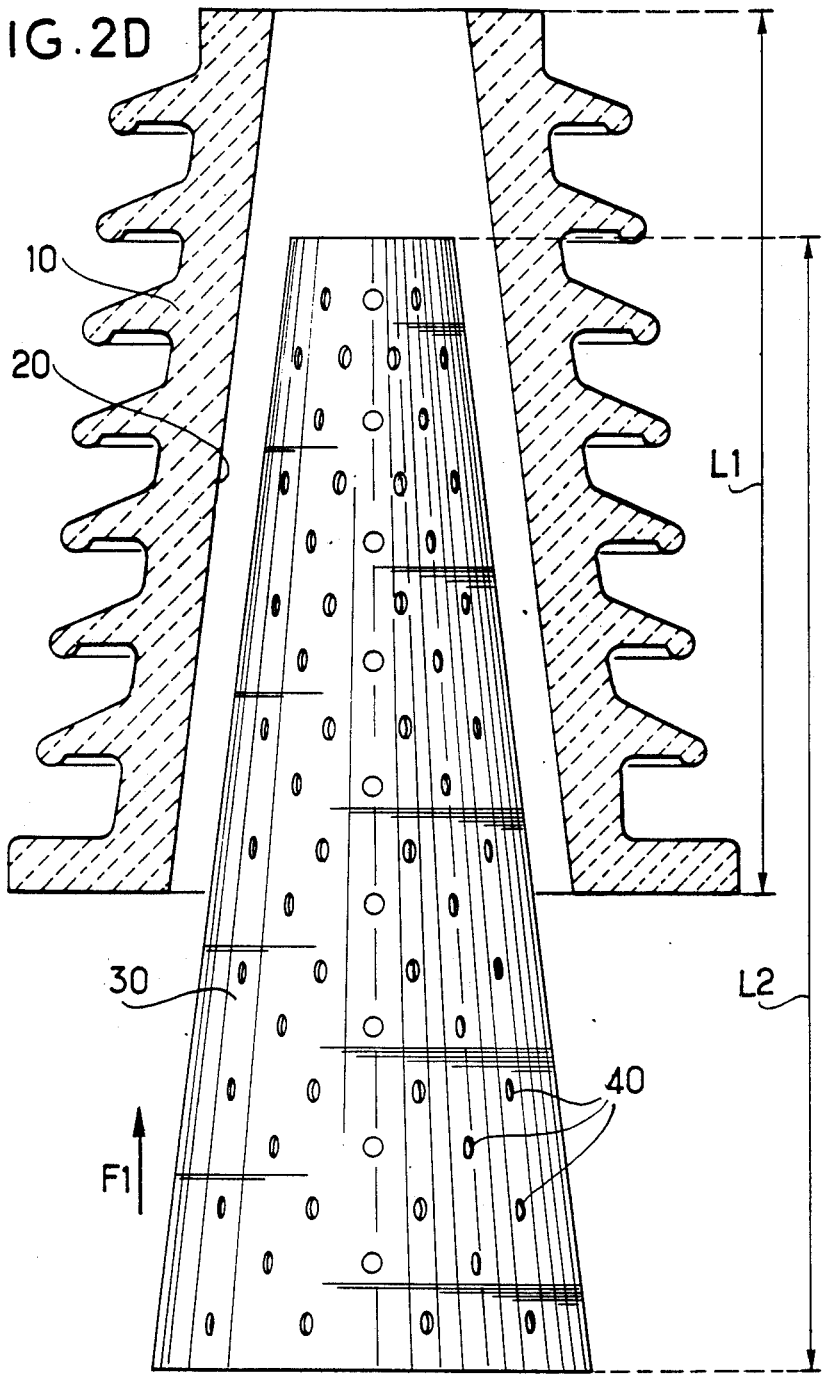
FIG. 2D is a diagram similar to FIG. 2A in which the sleeve is provided with a plurality of small holes prior to insertion of the sleeve into the cavity of the ceramic bushing 10.

The sleeve may be pierced with a plurality of small holes 40, FIG. 2D to avoid the formation of cavities between the sleeve 30 and the ceramic 10; otherwise such cavities would not fill with dielectric gas when the volume was filled and would give rise to harmful partial discharges.

The method according to the invention is cheap to implement, and bushings made thereby are free from any risk of explosion.

The invention can be used in all medium and high voltage power plants.

I claim:

1. A method of producing a ceramic insulating bushing to be filled with dielectric gas under pressure and which is free from any risk of explosion, said method comprising the following operations:

(1) manufacturing a ceramic bushing having an inside surface which is conical over the entire length of the bushing;

(2) making a conical sleeve of strong insulating material, said sleeve having the same cone angle as the inside surface of the bushing and having a length which exceeds that of the bushing;

(3) inserting the sleeve into the bushing until it makes contact with the entire inside surface of the bushing; and (4) cutting off the sleeve at the ends of the bushing.

2. The method according to claim 1; including the step of coating at least one of the outside surface of the sleeve and the inside surface of the bushing with adhesive prior to the sleeve contacting the bushing.

3. The method according to claim 2, further comprising the step, prior to inserting the sleeve into the bushing, of piercing said sleeve with a plurality of holes.

4. The method according to clain 1, further comprising the step, prior to inserting the sleeve into the bushing, of piercing said sleeve with a plurality of holes.

* * * * *

UNITED STATES PATENT AND TRADEMARK OFFICE

CERTIFICATE OF CORRECTION

PATENT NO. : 4,956,903

DATED : September 18, 1990

INVENTOR(S) : Edmond Thuries

It is certified that error appears in the above-identified patent and that said Letters Patent is hereby corrected as shown below:

On the title page, at [73] Assignee:, change "Societe Anmyne Dite, France" to -- Societe Anonyme Dite: ALSTHOM, Paris, France--.

Signed and Sealed this

Twenty-first Day of April, 1992

*Attest:*

HARRY F. MANBECK, JR.

*Attesting Officer*

*Commissioner of Patents and Trademarks*